US006523787B2

(12) United States Patent
Braband

(10) Patent No.: US 6,523,787 B2
(45) Date of Patent: Feb. 25, 2003

(54) METHOD AND DEVICE FOR CONTROLLING A TRAIN

(75) Inventor: Jens Braband, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/929,504

(22) Filed: Aug. 15, 2001

(65) Prior Publication Data

US 2002/0036252 A1 Mar. 28, 2002

(51) Int. Cl.[7] ..... B61L 27/00
(52) U.S. Cl. ..... 246/3; 246/167 R
(58) Field of Search ..... 246/3, 4, 6, 14, 246/55, 122 R, 167 R, 174, 209; 701/19, 20; 340/933, 988, 989

(56) References Cited

U.S. PATENT DOCUMENTS 4,018,410 A * 4/1977 Renaux ..... 104/88.03
5,364,047 A * 11/1994 Petit et al. ..... 246/122 R
5,532,690 A * 7/1996 Hertel ..... 180/167
5,803,411 A * 9/1998 Ackerman et al. ..... 246/169 R
6,135,396 A * 10/2000 Whitfield et al. ..... 246/167 R
6,182,011 B1 * 1/2002 Ward ..... 701/213

* cited by examiner

*Primary Examiner*—S. Joseph Morano
*Assistant Examiner*—Frantz F. Jules
(74) *Attorney, Agent, or Firm*—Morrison & Foerster, LLP

(57) ABSTRACT

The invention makes it possible to control a multiplicity of trains on a extensive railway systems using comparatively few complex means without it being necessary for there to be any knowledge of the route on the trains or any locating devices for the trains mounted along the route. For the trains to determine their own position, a satellite locating method is preferably used, which permits the travel location of a train, and thus its current stopping range, to be determined with sufficient precision. By determining such stopping ranges for the trains and by prescribing extensive route areas which apply for the trains, in each case in the form of polygons in a uniform coordinate system, it is possible reliably to detect any collisions of these polygons in order then to request in good time the assignment of current route areas or to start braking.

8 Claims, 1 Drawing Sheet

METHOD AND DEVICE FOR CONTROLLING A TRAIN

TECHNICAL FIELD OF THE INVENTION

A system and method for controlling a train, and in particular, a system and method of controlling a train by determining the location on the route.

BACKGROUND OF THE INVENTION

In radio-controlled travel operation, setting and securing route elements which are conventionally assigned to a signal box are distributed exclusively among local route element computers and vehicle-mounted computers (Signal+Draht [signal and wire] 4/99, pp 18–22). The operating states of the route elements and the positions of the vehicles on the route are visualized in a control center. In order to carry out a train journey, a traffic controller assigns a route to a train at its request by radio transmission. The assignment of the route includes a list of logic route sections which authorizes the train, and only this train, to travel along these route sections. Once a route assignment has been made, it continues to apply until it is completed or until it is rescinded. To safeguard the sequence of trains, neither signals nor intermittent train control devices are required. Rather, there is no need either for conventional track surveillance by means of axle counters or DC circuits because the trains themselves determine their respective travel location. Hence, the trains detect whether they are still located in the sections assigned to them, and detect the latest time at which they are to request new, updated route assignments and when they have to begin braking if such updated route assignments are not obtained. The system of radio-controlled travel operation provides protection against rear-end collisions, opposing collisions and slanting collisions of trains which are equipped with corresponding communication means. These collisions are prevented by braking curves at the limits of route sections and at hazard points. Route elements are preferably switches and railway crossings. The term train is used throughout this disclosure to describe both individual vehicles, as well as formations of vehicles formed from a plurality of individual vehicles.

The satellite is located at a position suitable for the trains to find their own location in the track network. The system is economical, reliable and subject to a relatively small locating error which can be reduced by additional means, for example fixed locating points arranged on the track. However, for a train to find its own location on a line, more than a satellite locating system is necessary. Instead, a route atlas (which reproduces the route with sufficient precision) is necessarily located in the train in radio-controlled travel operation mode so that the train can determine whether it is located within the travel sections assigned to it and precisely where it is located. Additionally, the vehicles have to convert their local positions acquired from the satellite locating method to the coordinates of their route atlas in order to find their way in the railway network.

In extensive railway systems, for example in North America or in Australia, there is the need (for cost reasons) to manage without such route atlases on the trains. Rather, the trains use exclusively satellite locating methods for determining their own position and for determining their travel location on the line. Hence, there should be no need for track-mounted infrastructure for carrying out the location-determining process on the track, as is also the case in radio-controlled travel operation.

SUMMARY OF THE INVENTION

In one embodiment of the invention, there is a method for controlling a train. The method includes, for example, assigning a route area to the train for which it is to travel, wherein the route area in which the train is to travel is a route polygon which covers a location of the train and a destination in the route area and within which the train has to stop; setting up a location space around the location of the train, the location space defined by a confidence interval of a location-determining process and a stopping distance; and braking when the location space touches, intersects or lies outside the polygon line of the route polygon.

In one aspect of the invention, the route polygon and the location space are defined as coordinates of a common coordinate system.

In another aspect of the invention, the train determines the location coordinates based on a satellite locating system.

In still another aspect of the invention, the location space to be set up by the train is defined as a polygon.

In yet another aspect of the invention, the destination of the train is predefined by the control center by two of the coordinates which define a straight line which intersects the track to be traveled along at the destination.

In another aspect of the invention, in order for the train to continue beyond the route polygon, the control center prescribes for the train a connecting route polygon which covers the destination of the previous route polygon.

In still another aspect of the invention, adjacent route polygons are logically linked by the two coordinates for the start and the destination of a train journey.

In another embodiment of the invention, there is a device for controlling a train. The invention includes, for example, a control center which assigns a route area in which the train is to travel; at least one route control center to prescribe a route polygon which covers a location of the train and a destination of the train in the route area and in which the train has to stop; and a vehicle-mounted unit to inform the train about the route polygon which is to be traveled along, and which is configured to set up the location space about the travel location determined by the train, the location space being dependent on a confidence interval of a location-determining process and a stopping distance of the train, the vehicle-mounted unit initiating the braking process if the location space touches, intersects or lies outside of the route polygon.

BRIEF DESCRIPTION OF THE DRAWINGS

The invention is explained in more detail below with reference to an exemplary embodiment illustrated in the drawing.

DETAILED DESCRIPTION OF THE PREFERRED EMBODIMENT

Figure 1:
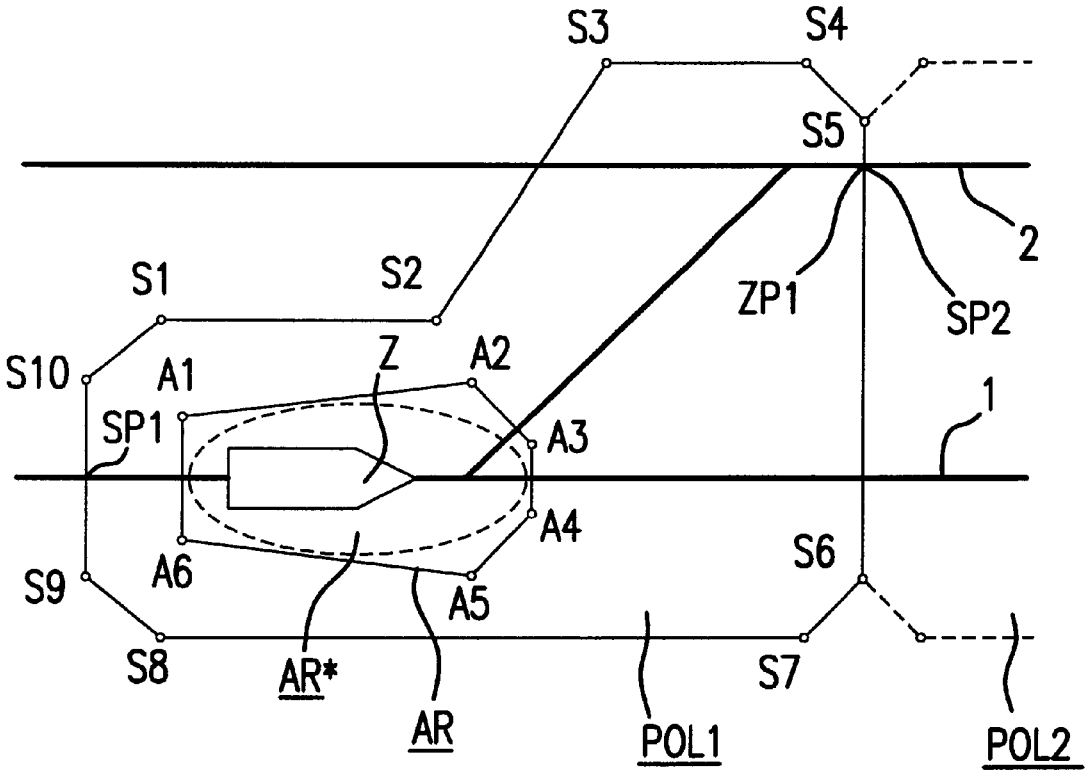
FIG. 1 shows a schematic view of a line section with two through tracks and a connecting track.

The present invention discloses a system and method with which it is possible for trains to move within a line area assigned to them by a control center without it being necessary for there to be a route atlas which reproduces the route on the trains.

Trains are not usually assigned the tracks which it is to travel along by the indication of the associated track sections, but rather the assignment of the route is performed by indicating an extensive line area within which the train has to stop. This extensive line area is described by the polygon which covers the location of the train and its destination, and whose vertices are defined in the coordinate system of the satellite locating device. This enables a train to determine its position within the assigned line area by the satellite locating device and to decide whether it may continue to travel along the line at an acceptable speed, should request an updated route assignment or should begin to brake in order to avoid a conflict. This determination is made by the train. The train defines a virtual location space around itself, which starts from the current result of the location-determining process and covers the confidence interval of the location-determining process and its respective stopping distance. If the stopping space, formed in this way, of the vehicle touches or intersects the assigned railway line polygon at any point, the train has to begin braking. The request for a new route assignment is expediently made before the train intersects with its virtual stopping space, the polygon of the assigned line area. The particular advantage in the description of polygons, both for the line area in which the train is respectively travelling and for the stopping space of a train, is that there are very efficient algorithms with which it is possible to determine whether specific points, in this case line points, lie within a polygon or outside, i.e. it is not necessary to develop any new software for the vehicle control according to the invention but instead it is possible to make use of proven existing software which has favorable effects on the development time of such a system and on the development and operating costs.

The invention is explained in more detail below with reference to an exemplary embodiment illustrated in the drawing.

The drawing shows a schematic view of a line section with two through tracks 1 and 2 and a connecting track 3. The track 1 can have a train Z travelling on it at any time. A control center assigns a railway line polygon SP1 at an earlier time to the train Z for the journey of the train Z from a starting point SP1 to a destination ZP1. This railway line polygon is defined by the coordinates S1 to S10. The railway line polygon SP1 covers the starting point and the destination of the train Z and the tracks which are necessary to reach this destination. The railway line polygon SP1 could also be in some other shape, for example the shape of a rectangle. The track sections which are to be traveled along from the starting point to the destination are covered by the railway line polygon. A larger railway line polygon which covers more than the tracks which are actually to be traveled along could lead to operational impediments if other trains wished to travel along the tracks, for example parts of the track 2, which are not actually required by the train Z1 to reach its destination. The vertices of the railway line polygon predefined by the line control center are given in the same coordinate system as the coordinates of the train-mounted locating system. In this way, the train can determine without difficulty whether it is located within the railway line polygon assigned to it. A route atlas is not required, nor is there any need to convert position information into different coordinate systems. However, the train Z does not know about the actual routing of the track, only that the train Z is located within an extensive line area which is assigned to it, and/or is approaching its boundary.

The train Z preferably determines its position within the railway system on which it is travelling by a satellite location-determining process. The respective result of the location-determining process is subject to a certain degree of uncertainty of the order of magnitude of several meters. The actual travel location of the train lies in a location-determining interval which is dependent on the accuracy of the location-determining process, this being what is referred to as the confidence interval of the location-determining process, which is known to the train Z. In order to be able to start a braking process in the time required, the vehicle accounts for not only a location space defined by the result of the location-determining process and the respective confidence interval of the location-determining process but also its stopping distance. This can be done by taking into account a braking distance starting from a maximum traveling speed and a minimum braking deceleration, or alternatively by taking into account the actual traveling speed of the train Z and its actual braking capacity. The train Z is informed of both variables. The respective stopping distance increases the location space in which a given train is located and within which it should come to a standstill when a braking process is initiated. Since the train Z does not know about the actual routing of the track, it takes into account several factors for its location space. Not only is a stopping distance lying directly in front of it in the direction of travel accounted for, but so is the stopping distances for possible tracks which branch off. This results in a somewhat ellipsoidal configuration of the stopping space AR*.

For the following considerations it is assumed that the train Z does not take into account these ellipses as the stopping space, but rather a stopping polygon AR which includes the ellipses and which is defined by the coordinates A1 to A6. The reason for prescribing a stopping polygon instead of a stopping ellipse (which is in itself more selective) is that the relative position of such a polygon in a railway line polygon can be determined more easily than that of an ellipse. Additionally, when the train Z moves forward the stopping polygon can easily be moved along with the train Z by prescribing updated coordinates for the vertices of the polygon.

At the latest, when the train Z detects that it is intersecting, with its stopping polygon AR, the polygon line of the railway polygon SP1, it begins braking. It then comes to a standstill before the line of the railway line polygon, irrespective of the actual profile of the track up to the stopping point.

In the event that the line control center rescinds or restricts the railway line polygon assigned to a train Z, the train Z which is traveling along this polygon may have already moved forward to such an extent that its stopping polygon already intersects the polygon line of the railway line polygon newly assigned to it, or lies outside the railway line polygon. In this case, the train Z also initiates the braking process in order to keep the risk for itself and for other trains as low as possible.

If, as in the illustrated exemplary embodiment, the train Z approaches its destination ZP1 in the route polygon SP1 assigned to it, it communicates with the railway line control center before the braking process is initiated. This ensures assignment by the railway line control center to a connecting railway line polygon which is necessary to continue the journey. The train Z can itself determine the time at which it will get in contact with the railway line control center, on the basis of knowledge of the current distance of its stopping polygon from its destination. The destination, in the illustrated example the destination ZP1, is indirectly defined in the railway line control center by the coordinates of the coordinates S5 and S6, which mark the boundary of the railway line polygon SP1 in the direction of travel. In this case, the train Z does not know about the actual routing of the railway line. When the preconditions for this are present, the railway line control center assigns a connecting railway line polygon SP2 to the train Z which is approaching the destination ZP1. The connecting railway line polygon SP2 is preferably logically connected, by means of the coordinates of at least two vertices, to the railway line polygon SP1 on which the train Z is still traveling. In this way, the assignment of railway line polygons by the railway line control center can be subjected to a plausibility test. When adjacent railway line polygons are in contact, as in the present exemplary embodiment, the destination ZP1 in the respective previous railway line polygon SP1 simultaneously forms the starting point SP2 in the following railway line polygon SP11.

What is claimed is:

1. A method for controlling a train, comprising:

assigning a route area to the train for which it is to travel, wherein the route area is a route polygon which covers a location of the train and a destination in the route area and within which the train has to stop;

setting up a location space around the location of the train, the location space defined by a confidence interval of a location-determining process and a stopping distance; and braking when a boundary of the location space touches, intersects or lies outside a polygon line of the route polygon, wherein in order for the train to continue beyond the route polygon, the control center prescribes for the train a connecting route polygon which covers the destination of the previous route polygon.

2. The method as claimed in claim 1, wherein the route polygon and the location space are defined as coordinates of a common coordinate system.

3. The method as claimed in claim 2, wherein the train determines the location coordinates based on a satellite locating system.

4. The method as claimed in claim 1, wherein the location space to be set up by the train is defined as a polygon.

5. The method as claimed in claim 1, wherein the destination of the train is predefined by the control center by two of the coordinates which define a straight line which intersects the track to be traveled along at the destination.

6. A device for controlling a train, comprising:

a control center which assigns a route area in which the train is to travel;

at least one route control center to prescribe a route polygon which covers a location of the train and a destination of the train in the route area and in which the train has to stop; and a vehicle-mounted unit to inform the train about the route polygon which is to be traveled along, and which is configured to set up the location space about the travel location determined by the train, the location space defined by a confidence interval of a location-determining process and a stopping distance of the train, the vehicle-mounted unit initiating the braking process when a boundary of the location space touches, intersects or lies outside of a polygon line of the route polygon, wherein in order for the train to continue beyond the route polygon, the control center prescribes for the train a connecting route polygon which covers the destination of the previous route polygon.

7. A method for controlling a train, comprising:

assigning a route area to the train for which it is to travel, wherein the route area is a route polygon which covers a location of the train and a destination in the route area and within which the train has to stop;

setting up a location space around the location of the train, the location space defined by a confidence interval of a location-determining process and a stopping distance;

braking when a boundary of the location space touches, intersects or lies outside a polygon line of the route polygon, wherein the destination of the train is predefined by the control center by two of the coordinates which define a straight line which intersects the track to be traveled along at the destination, and in order for the train to continue beyond the route polygon, the control center prescribes for the train a connecting route polygon which covers the destination of the previous route polygon.

8. The method as claimed in claim 7, wherein adjacent route polygons are logically linked by the two coordinates for the start and the destination of a train journey.

* * * * *